United States Patent [19]

Kumakawa et al.

[11] Patent Number: 4,690,866

[45] Date of Patent: Sep. 1, 1987

[54] POLYESTER FIBER

[75] Inventors: Shiro Kumakawa; Kazuyuki Yamamoto, both of Matsuyama, Japan

[73] Assignee: Teijin Limited, Osaka, Japan

[21] Appl. No.: 751,796

[22] Filed: Jul. 3, 1985

[30] Foreign Application Priority Data

| | | | |
|---|---|---|---|
| Jul. 9, 1984 | [JP] | Japan | 59-140655 |
| Aug. 2, 1984 | [JP] | Japan | 59-161623 |
| Nov. 29, 1984 | [JP] | Japan | 59-250552 |

[51] Int. Cl.[4] ..... D02G 3/00

[52] U.S. Cl. ..... 428/364; 428/375; 528/308.1; 528/308.2

[58] Field of Search ..... 428/364, 395; 528/308.1, 308.2; 264/210.8, 290.5

[56] References Cited

U.S. PATENT DOCUMENTS

| | | | |
|---|---|---|---|
| 3,481,136 | 12/1969 | Timmons, Jr. et al. | 264/290.5 X |
| 3,564,835 | 2/1971 | Keefe, Jr. et al. | 264/290.5 X |
| 3,651,198 | 3/1972 | Mitsuishi et al. | 264/290.5 X |
| 4,070,432 | 1/1978 | Tamaddon | 264/290.5 X |
| 4,101,525 | 7/1978 | Davis et al. | 264/290.5 X |
| 4,113,821 | 9/1978 | Russell et al. | 264/290.5 X |
| 4,195,161 | 3/1980 | Davis et al. | 528/308.2 |

*Primary Examiner*—Lorraine T. Kendell

*Attorney, Agent, or Firm*—Burgess, Ryan & Wayne

[57] ABSTRACT

A polyester fiber composed of a polyester comprising ethylene terephthalate units as the main recurring units and having an intrinsic viscosity of at least 0.9, which has an amorphous orientation degree of 0.3 to 0.55 and a crystal melting point of at least 265° C.

8 Claims, 2 Drawing Figures

POLYESTER FIBER

BACKGROUND OF THE INVENTION (1) Field of the Invention

The present invention relates to a polyester fiber having a high strength, a low shrinkage, a good fatigue resistance and a good drawablity, which is valuable as an industrial material.

(2) Description of the Prior Art

Polyester fibers are broadly used not only as a textile material but also as an industrial material because they have various excellent characteristics. Especially, a polyester fiber having a high strength and an excellent dimension stability is very valuable as an industrial material and is used for the production of tires and other industrial products. However, higher properties are recently required for polyester fibers. For example, in the field of the production of the conveyor belts and rubber hoses, a much reduced shrinkability is required in view of the dimension stability at the modeling step and it is required to impart durability and fatigue resistance capable of resisting severe application conditions to starting polyester fibers. Furthermore, in the field of tire cords, in order to improve the yield at the tire-forming step, it is required to further reduce the shrinkability, and in order to improve the driving comfortability, it is required to increase the modulus. Moreover, in the application to large-size tires, improvement of the fatigue resistance is desired, and in case of cords for V-belts, increase of the modulus is required to attain a maintenance-free effect and in case of cords for large-size high-load wrapped belts, high elongation, high toughness and high fatigue resistance are required. In view of the foregoing, it is considered that if there is provided a polyester cord having a high strength, a low shrinkability, a high modulus and a high fatigue resistance in combination, the superiority of the polyester fiber to other materials in the manufacturing cost will be increased and the application field will be further broadened.

The polyester fiber is inferior to older rayon and Vinylon fibers in the modulus and shrinkability and is much inferior to older general-purpose polyamide fibers in the fatigue resistance, and it is important to improve these insufficient properties. If these poor properties are improved, the superiority of the polyester fiber to rayon, Vinylon and polyamide fibers in the cost and performance will be increased and the polyester fiber will be more highly evaluated as in industrial material.

As means for realizing a high strength required for an industrial fiber, there is known a process in which a polyester having a high degree of polymerization is used, the molecular orientation is controlled at the spinning step and the drawing ratio is increased to a level as high as possible at the drawing step, as disclosed in Japanese Examined Patent Publications No. 41-7892 and No. 53-1367. According to this process, however, a polyester fiber having high strength and toughness can be obtained but a polyester fiber having low shrinkage can hardly be obtained. As means for reducing the shrinkability, there is known a process in which a polyester fiber is heat-treated at a high temperature under a low tension after multi-staged drawing, as disclosed in Japanese Examined Patent Publication No. 58-51524. However, this process is defective in that only a fiber having a lower fatigue resistance is obtained as in the above-mentioned known process.

As means for improving the fatigue resistance while maintaining the shrinkability at a low level, for example, Japanese Unexamined Patent Publications No. 53-58031 and No. 53-58032 propose a process in which the molecular orientation of a drawn yarn of a polyester fiber is reduced and the work loss is reduced. This process is characterized in that a polyester fiber is rapidly cooled just below a spinneret by a gas atmosphere maintained at 10° to 60° C. However, since drawing is performed to the point just before the point of breakage so as to increase the strength, the elongation is extremely low, and since yarn breakage frequently occurs at the drawing step, the process is defective in that stable production is difficult.

SUMMARY OF THE INVENTION

Reasearch was conducted with a view to providing an industrial polyester fiber having in combination a high strength, a low shrinkage comparable to that of a rayon or Vinylon fiber, a fatigue resistance higher than that of a rayon or Vinylon fiber and a good drawability. As the result, it was found that only where a polyester has a specific degree of polymerization and where an amorphous portion and a crystalline portion are in a specific state, a polyester fiber having a high strength, a low shrinkability, a good fatigue resistance and a good drawability can be obtained. We have now completed the present invention based on this finding.

More specifically, in accordance with the present invention, there is provided a polyester fiber composed of a polyester comprising ethylene terephthalate units as main recurring units and having an intrinsic viscosity of at least 0.90, wherein the amorphous orientation degree is in the range of from 0.30 to 0.55 and the crystal melting point is at least 265° C.

DETAILED DESCRIPTION OF THE PREFERRED EMBODIMENTS

Figure 1:
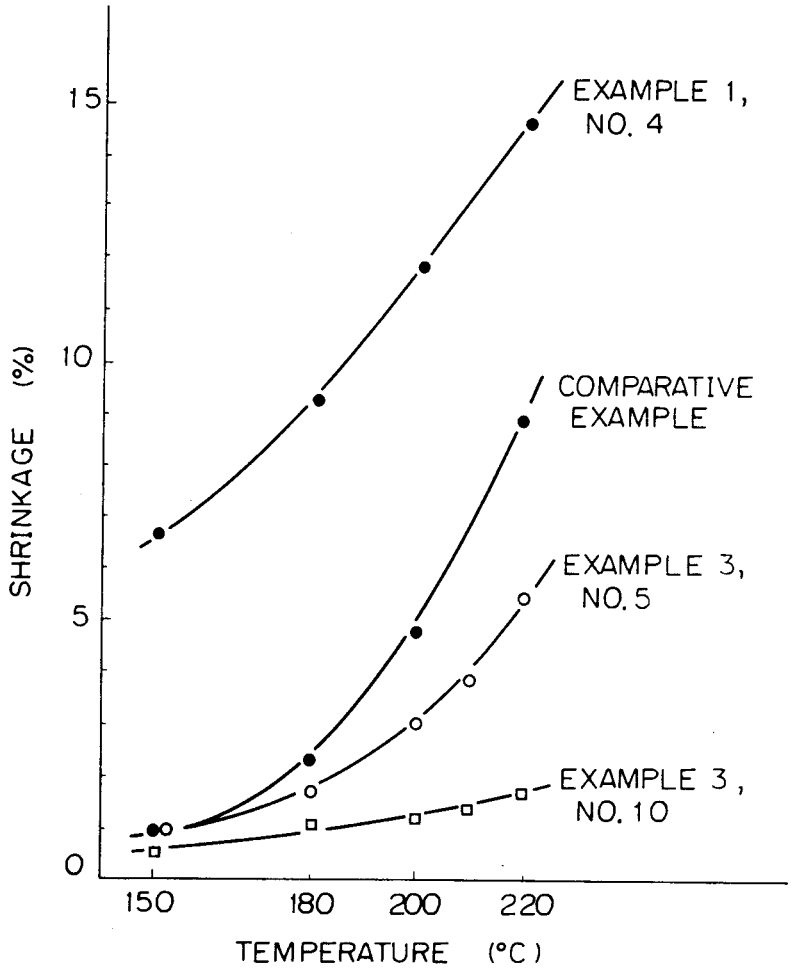
FIG. 1 shows temperature-shrinkage factor curves of fibers obtained in the examples of the present invention and the comparative examples.

The polymer constituting the polyester fiber of the present invention is a polyester comprising at least 90 mole %, preferably at least 95 mole %, of ethylene terephthalate recurring units in the molecule chain. Polyethylene terephthalate is preferred as the polyester, but up to 10 mole %, preferably up to 5 mole %, of other comonomer component may be included. As the comonomer components, there can be mentioned, for example, isophthalic acid, naphthalene-dicarboxylic acid, adipic acid, hydroxybenzoic acid, diethylene glycol, propylene glycol, trimellitic acid and pentaerythritol. Moreover, the polyester may contain additives such as a stabilizer and a colorant.

It is indispensable that the polyester fiber of the present invention should have an intrinsic viscosity of at least 0.90 as measured at 25° C. with respect to an o-chlorophenol solution. If the intrinsic viscosity is lower than 0.90, a polyester fiber having a high strength cannot be obtained while maintaining a low shrinkability and a high fatigue resistance. It is preferred that the intrinsic viscosity be in the range of from 0.90 to 1.30.

The amorphous orientation degree specified in the present invention has an influence on the shrinkable factor and strength of the obtained drawn fiber. In the fiber of the present invention, the amorphous orientation degree is 0.30 to 0.55 and preferably 0.35 to 0.50. If the amorphous orientation degree exceeds 0.55, a fiber having a desirable shrinkage factor cannot be obtained, and if the amorphous orientation degree is lower than 0.30, a strength sufficient to resist practical applications cannot be obtained.

The crystal melting point has an influence on the residual strength obtained when the obtained drawn fiber is subjected to a high-temperature treatment (dry heat treatment or wet heat treatment) directly or after formation into a fabric. The crystal melting point of the fiber of the present invention is at least 265° C., preferably at least 270° C. If the crystal melting point is lower than 265° C., degradation of the strength at the high-temperature treatment is large and the fiber is not preferred from the practical viewpoint.

The polyester fiber of the present invention has preferably a crystal volume of at least $4.0\times10^5$ Å$^3$. If the crystal volume is smaller than $4.0\times10^5$ Å$^3$, when the fiber is subjected to a heat treatment directly after formation into a woven or knitted fabric, degradation of the strength readily occurs.

The polyester fiber of the present invention preferably has a dry-heat shrinkage factor at 210° C. of less than 6%, especially less than 4%. The dry heat shrinkage factor has an influence on the dimension stability of the drawn fiber or a fabric formed therefrom at a high temperature treatment. If the dry heat shrinkage factor exceeds 6%, this dimension stability is poor, and in case of a fabric, wrinkling is readily caused or the quality or post processability is degraded.

Moreover, the polyester fiber of the present invention preferably has a terminal modulus of up to 10 g/d, especially up to 9 g/d. The terminal modulus has an influence on the residual strength after the twisting operation when the fiber is used in the form of a twisted yarn. If the terminal modulus exceeds 10 g/d, the loss of the strength at the twisting step is large and hence, it is necessary to extraordinarily increase the strength of the drawn fiber.

In view of the temperature dispersion behavior of the dynamic loss elasticity modulus, it is preferred that the amorphous portion of the polyester fiber of the present invention should simultaneously satisfy the following two requirements.

(1) The half-value width of the main component appearing in the temperature dispersion of the dynamic loss elasticity modulus is less than 45° C.

(2) The peak temperature of said main dispersion component is lower than 125° C.

This half-value width indicates the distribution of the amorphous orientation degree in the amorphous region, and the smaller the half-value width, the smaller the distribution. If the half-value width exceeds 45° C., when a stress acts on the fiber, the stress is concentrated on a specific molecule chain in the amorphous region and this molecule chain is readily broken, and the fatigue resistance is reduced and good results cannot be obtained. The peak temperature of the main dispersion component indicates the molecular orientation degree of the amorphous region, and the lower the peak temperature, the lower the orientation degree. It the peak temperature exceeds 125° C., the orientation degree is high and the strength is increased, but the requirements of low shrinkability and high fatigue resistance are not satisfied.

Although the amorphous orientation degree of the polyester fiber of the present invention is not so high, the molecule chain length expressed by the intrinsic viscosity is long and the distribution of the amorphous orientation degree is narrow, and by combination of this amorphous portion with the crystalline portion described below, a fiber having a desirable strength, a low shrinkability and a high fatigue resistance can be provided.

Furthermore, the fiber of the present invention preferably has a long-period spacing of at least 160 Å.

The fiber of the present invention preferably has a specific fiber structure owing to the amorphous portion and crystalline portion. More specifically, in the thermal stress curve of the fiber of the present invention, there appear peaks at a temperature of 100° to 180° C. and at a temperature higher than 180° C., respectively (see FIG. 2). The former thermal stress peak is relative to the amorphous portion in the fiber structure and the latter thermal stress curve is relative to the crystalline portion.

The polyester fiber of the present invention has a strength of at least 6.0 g/d, which is sufficiently high for industrial applications, and also has an elongation of at least 10%, preferably at least 20%, and high toughness and high durability.

The polyester fiber of the present invention can be prepared, for example, according to the following process.

A polyester having ethylene terephthalate recurring units as the main recurring units and an intrinsic viscosity of 0.95 to 1.5 or a reaction product of a polyester having ethylene terephthalate units as the main recurring units and an intrinsic viscosity of 0.7 to 0.9 with a polymerization degree increaser is method and transported according to customary procedures and is then extruded from a spinneret in the form of a yarn so that the single filament denier after drawing is 1 to 20 and the total denier after drawing is 500 to 2000. Immediately after extrusion, the extruded yarn is rapidly cooled, or the extruded yarn is maintained at a temperature lower than the melting point but higher than the crystallization-initiating temperature or is exposed to a heating atmosphere maintained at a temperature higher than the melting point for a certain time and delayed cooling is carried out. Then, the yarn is cooled and solidified, and it is preferred that this cooling solidification be carried out under conditions represented by the following formula:

$$400 \leqq \frac{X \times \sqrt{Y}}{Q} \leqq 1900$$

wherein X stands for the distance between the surface of the spinneret and the blow-out surface of cooling air (room temperature), which is smaller than 450 mm, Y stands for the blow-out length of cooling air, which is 100 to 500 mm, and Q stands for the blow-out rate of cooling air, which is 2 to 6 Nm$^3$/min. After this cooling solidification, an oiling agent is applied to the yarn, and the yarn is taken up at a speed of at least 2000 m/min. The oiling agent may be applied according to an optional method, for example, an oiling roller method or a spraying method. An optional oiling agent for fibers may be applied. In the case where adhesiveness to rubber is important, it is preferred that a surface treating agent be applied to increase the adhesiveness.

If the above-mentioned conditions are appropriately selected, there can be obtained a crystalline undrawn fiber which is characterized in that the intrinsic viscosity is at least 0.90, the elongation at break is less than 150%, the birefringence is at least 0.06, and the crystallization degree Xx and birefringence Δn satisfy the following requirement:

$$Xx = 2.4 \times 10^2 \times \Delta n + 4$$

wherein Xx stands for the crystallization degree determined by the X-ray wide-angle diffractometry and Δn stands for the birefringence which is at least 0.06.

This undrawn fiber can also be prepared according to the process in which the draft ratio of the extruded fiber between the spinneret and the take-up point is 300 to 7000, the orifice diameter of the spinneret is 0.55 to 2.5 mm and the take-up speed is 2000 to 6000 m/min. By the term "draft ratio" used herein is meant the ratio of the fiber take-up speed to the linear speed of extrusion of the polymer (the speed at the orifice outlet).

In the present invention, the undrawn fiber taken up at the above-mentioned speed, which has the above-mentioned characteristics, may be drawn subsequently to the spinning operation or may be wound and then drawn at a different step. In the case where drawing is carried out subsequently to spinning, the process proposed in Japanese Patent Application No. 57-88927 may be adopted. In the case where the undrawn yarn is wound and then drawn, there may be adopted the process proposed in Japanese Patent Application No. 57-189094. The latter process is preferred in view of reduction of the drawing strain at the drawing step or the heat treatment strain. According to this drawing process, the undrawn fiber is preheated at a temperature in the range of from Tg+15° C. to Tg +50° C. (Tg stands for the glass transition temperature of the fiber) for at least 0.5 second, the fiber is subjected to first-stage drawing at a 'raw ratio corresponding to less than 75% of the total drawn ratio to increase the birefringence to a level 1.2 to 3.3 times the birefringence of the undrawn fiber. Then, the fiber subjected to the first-stage drawing is subjected to the subsequent stage drawing and heat treatment. In the industrial field where the drawn fiber is directly used without formation of the drawn fiber into a cord, it is preferred that after the subsequent stage drawing, the drawn fiber be subjected to a heat treatment at a temperature in the range of from (fusing temperature—50° C.) to (fusing temperature—110° C.) for 0.4 to 1.5 seconds under a relax of 10 to 20%.

The so-obtained polyester fiber is woven or knitted and is used for an industrial purpose directly or after a heat treatment. At this time, excellent fiber characteristics are directly manifested without any reduction and the fiber can be used very effectively. Furthermore, there may be adopted a method in which the fiber is formed into a cord according to customary procedures, an adhesive is applied to the cord, and the cord is heat-treated and applied to a rubber structure. By the term "rubber structure" is meant all of structures composed of natural rubber and synthetic rubber, such as tires, hoses, V-belts and conveyor belts. The fiber of the present invention is especially valuable as a weft of a rubber-reinforcing woven fabric, a reinforcer for a resin hose or rubber hose, an electrically insulating material, a resin reinforcer and an optical fiber reinforcer.

Properties referred to in the instant specification and appended claims are determined according to the following methods.

(1) The amorphous orientation degree fa is determined according to the method described in the report of Robert J. Samuel [J. Polymer Science, A2, 10, 781 (1972)] by using the following calculating formula:

$$\Delta n = Xfc\Delta nc + (1-x)fa\Delta na$$

In the above formula, Δn is a parameter indicating the orientation degree of the molecules in the filament, which is determined by the retardation method using a Berek compensator in the state where a sample is immersed in bromonaphthalene. This method is described in detail in Lectures of Polymer Experiments, Physical Properties of Polymers, Volume II: published by Kyoritsu Shuppan.

Incidentally fc stands for the crystalline orientation degree determined according to customary procedures from the average orientation angle measured by the X-ray wide-angle diffractometry, X stands for the crystallization degree determined from the density according to customary procedures, and Δnc and Δna stand for inherent birefringences of crystalline and amorphous portions, which are 0.220 and 0.275, respectively, in case of polyethylene terephthalate.

(2) The crystal melting point is determined by using Model DSC-I supplied by Perkin-Elmer Co. at a temperature-elevating rate of 20° C./min, and the value of the endothermic peak is designated as the crystal melting point.

(3) The 210° C. dry-heat shrinkage factor is determined according to the method of JIS L-1017-1963 (5.12).

(4) The crystal volume is calculated according to the formula:

Crystal volume = (crystal size in direction of axis $\underline{a}$) × (crystal size in direction of axis $\underline{b}$) × (long-period spacing) × (crystallization degree)

The crystal size is determined according to the formula of Scherrer from half-value widths of interference peaks of planes (010) and (100).

The crystallization degree is calculated according to the Sakurada-method.

(5) The terminal modulus is obtained by dividing the increase of stress on the point of the elongation, which corresponds to 2.4% subtraction from the elongation at break on the load-elongation curve of a sample fiber, by $2.4 \times 10^{-2}$. Incidentally, the load-elongation curve is determined by JIS L-1017-1963 (5.4).

(6) The dynamic loss elasticity modulus is determined by using a spectrometer (Model VES-F supplied by Iwamoto Seisakusho) under a frequency of 10 HZ with 0.17% amplitude at a temperature-elevating rate of 1.6° C./min while applying a load of 0.25 g/d on a sample having length of 3 cm. The half-value width of the main component means the temperature width of the peak corresponding to ½ of the peak value of the main component.

(7) The long-period spacing is determined by using a small-angle X-ray scattering measuring apparatus according to a known method. Namely, Cu-Kα ray having a wavelength of 1.54 Å is used as the ray source and applied to the fiber axis rectangularly thereto, and the long-period spacing is calculated from the obtained diffraction line of the meridional interference by using Bragg's formula.

(8) Thermal stress curve is determined under an initial load of 50 g at a temperature-elevating rate of 4° C. by using a known apparatus.

The present invention will now be described with reference to the following examples. Incidentally, all of "parts" in the examples are by weight. The physical properties of treated cords mentioned in the examples are those determined by the following methods.

(1) The load-elongation curve was determined according to JIS L-1017-1963 (5.4).

(2) The tube life was determined according to the method 1.3.2.1-A of JIS L-1017-1963. The bending angle was adjusted to 90°.

(3) The heat-resistant tenacity was determined in the following manner. Namely, a green cord was immersed in an RFL adhesive solution and heat-treated at 245° C. under tension for 2 minutes. The treated cord was embedded in a curing mold and curing was promoted at 170° C. under a pressure of 50 kg/cm$^2$ for 120 minutes. The treated cord was taken out and the tenacity was measured.

EXAMPLE 1

An autoclave was charged with 97 parts of dimethyl terephthalate, 69 parts of ethylene glycol, 0.034 part of calcium acetate monohydrate and 0.025 parts of antimony trioxide, and ester exchange reaction was carried out at 180° to 230° C. while gradually introducing nitrogen and removing methanol formed by the reaction. Then, 0.05 part of a 50% aqueous solution of $H_3PO_4$ was added and the temperature was elevated to 280° C., and the pressure in the reaction system was reduced to 0.2 mmHg over a period of about 1 hour and polymerization was conducted for 1 hour and 50 minutes to obtain a polymer having an intrinsic viscosity of 0.80 and a terminal carboxyl group concentration of 28 equivalents per $10^6$ g of the polymer. Then, 100 parts of the polymer chip was dry-blended with 2,2'-bis(2-oxazoline) (CE) in an amount shown in Table 2. The blend was melted at about 300° C. and transported, and the melt was extruded from a spinneret having 250 holes, each having a diameter of 0.6 mm. The extrudate was maintained under a condition shown in Table 2 and cooled and solidified by blowing cooling air maintained at 25° C. to the extruded yarn at a rate of 4.0 Nm$^3$/min along a length of 300 mm. Then, an oiling agent was applied to the extruded yarn by an oiling roller and the extruded yarn was wound at a speed shown in Table 1. The properties of the so-obtained undrawn yarn are shown in Table 1.

The resulting undrawn fiber was supplied to a roll heated at 85° C. and subjected to first stage drawing between this roll and take-up roll at a drawn ratio ($DR_1$) shown in Table 1. Then, the fiber was subjected to second stage drawing through a gas bath maintained at 325° C. at a drawn ratio ($DR_2$) shown in Table 1. The, the fiber was subjected to a stretch heat treatment at a drawn ratio shown in Table 1 by using a roller heated at 130° C. and a gas bath maintained at 330° C. The properties of the obtained drawn yarn are shown in Table 1.

The obtained drawn yarn was Z-twisted at 490 turns per meter, and two of the so-twisted yarns were combined and S-twisted at 490 turns per meter to obtain a green cord of 1000 denier×2 yarns. The green cord was dipped in an adhesive (RFL) solution and heat-treated under stretch at 245° C. for 2 minutes. The properties of the treated cord were measured, and the treated cord was embedded in a rubber and curing was effected and the tube life and heat-resistant strength were measured. The obtained results are shown in Table 1.

Incidentally, the tube life in Table 1 indicates the fatigue resistance. A cord was prepared and the tube life was measured in the manner described below.

The drawn yarn was Z-twisted at 490 turns per meter, and two of so-twisted yarns were combined and the doubled yarn was S-twisted at 490 turns per meter to obtain a green cord of 1000 denier×2 yarns. The green cord was immersed in an adhesive (RFL solution) and subjected to a heat treatment under stretch at 245° C. for 2 minutes. The treated cord was embedded in a rubber and curing was performed, and the tube life was determined according to the above-mentioned method.

Temperature-shrinkage factor curves of the fiber of Run No. 4 (comparison) is shown in FIG. 1.

TABLE 1

| | Run No. | | | | | | | | | | | | | |
|---|---|---|---|---|---|---|---|---|---|---|---|---|---|---|
| | 1 (com) | 2 | 3 | 4 (com) | 5 | 6 | 7 | 8 | 9 | 10 | 11 | 12 | 13 | 14 |
| Amount (% by weight) of Added CE | 0.05 | 0.15 | 0.22 | 0.15 | 0.15 | 0.15 | 0.15 | 0.15 | 0.15 | 0.15 | 0.15 | 0.15 | 0.15 | 0.15 |
| Cooling Conditions | | | | | | | | | | | | | | |
| Length (mm) of Heating Zone below Spinneret | 100 | 100 | 100 | 300 | 300 | 300 | 300 | 300 | 100 | 200 | 200 | 200 | 200 | 300 |
| Temperature (°C.) of Heating Zone | 230 | 230 | 230 | 230 | 230 | 230 | 230 | 230 | 230 | 230 | 230 | 300 | 350 | 350 |
| Cooling Air Blow-out Distance (mm) | 180 | 180 | 180 | 440 | 440 | 440 | 440 | 440 | 180 | 280 | 350 | 350 | 350 | 440 |
| Take-up Speed (m/min) | 3500 | 3500 | 3500 | 2500 | 3500 | 4000 | 5000 | 6000 | 4000 | 4000 | 4000 | 4000 | 4000 | 4000 |
| Undrawn Fiber | | | | | | | | | | | | | | |
| Intrinsic Viscosity | *0.86 | 0.95 | 1.01 | 0.93 | 0.95 | 0.95 | 0.96 | 0.96 | 0.95 | 0.95 | 0.94 | 0.94 | 0.93 | 0.92 |
| Terminal Carboxyl Group Concentration (equivalent/$10^6$ g) | 18.5 | 7.2 | 6.5 | 7.8 | 7.3 | 7.2 | 7.0 | 6.8 | 7.3 | 7.2 | 7.5 | 7.5 | 8.0 | 8.2 |
| Elongation (%) | 88 | 65 | 52 | *160 | 102 | 89 | 68 | 43 | 36 | 54 | 76 | 104 | 116 | 139 |

TABLE 1-continued

| | Run No. | | | | | | | | | | | | | |
|---|---|---|---|---|---|---|---|---|---|---|---|---|---|---|
| | 1 (com) | 2 | 3 | 4 (com) | 5 | 6 | 7 | 8 | 9 | 10 | 11 | 12 | 13 | 14 |
| at Break | | | | | | | | | | | | | | |
| Birefringence | 0.0734 | 0.0866 | 0.0954 | *0.0453 | 0.0626 | 0.0814 | 0.0927 | 0.1081 | 0.136 | 0.115 | 0.0948 | 0.0875 | 0.0796 | 0.0657 |
| Crystallization Degree (%) | 21.7 | 24.6 | 27.1 | 14.7 | 19.3 | 23.6 | 26.5 | 30.3 | 36.8 | 31.5 | 26.8 | 25.3 | 23.4 | 20.1 |
| Draw Ratio | | | | | | | | | | | | | | |
| $DR_1$ | 1.4 | 1.3 | 1.3 | 1.7 | 1.5 | 1.4 | 1.3 | 1.25 | 1.2 | 1.25 | 1.3 | 1.5 | 1.55 | 1.6 |
| $DR_2$ | 1.21 | 1.23 | 1.19 | 1.22 | 1.19 | 1.20 | 1.22 | 1.19 | 1.16 | 1.20 | 1.22 | 1.18 | 1.18 | 1.19 |
| $DR_3$ | 1.01 | 1.005 | 1.00 | 1.025 | 1.01 | 1.01 | 1.005 | 1.00 | 1.00 | 1.00 | 1.005 | 1.01 | 1.015 | 1.020 |
| Draw Lap at $DR_2$ | not | not | small | not | not | not | not | small | large | not | not | not | not | not |
| Drawn Yarn | | | | | | | | | | | | | | |
| Fineness (denier) | 1005 | 1003 | 1006 | 1001 | 1002 | 1003 | 1002 | 1001 | 1006 | 1003 | 1002 | 1004 | 1003 | 1005 |
| Strength (g/d) | 5.8 | 6.8 | 7.8 | 8.3 | 8.3 | 7.8 | 7.6 | 7.0 | 6.2 | 6.8 | 7.5 | 8.0 | 8.1 | 8.2 |
| Elongation (%) | 11.2 | 10.8 | 10.6 | 10.5 | 11.6 | 10.6 | 10.3 | 10.1 | 10.3 | 10.2 | 10.2 | 10.2 | 10.5 | 10.4 |
| 210° C. Dry-heat Shrinkage Factor (%) | 10.4 | 9.3 | 7.7 | 12.2 | 10.6 | 9.8 | 8.1 | 7.2 | 5.3 | 6.4 | 7.8 | 9.2 | 9.9 | 10.3 |
| Long-period spacing (Å) | 162 | 164 | 166 | *138 | *155 | 161 | 164 | 168 | 172 | 169 | 166 | 164 | 162 | *153 |
| Melting Point (°C.) | 265 | 271 | 274 | *259 | *264 | 272 | 275 | 276 | 277 | 276 | 274 | 273 | 272 | 272 |
| Crystal Volume ($\times 10^5$ Å$^3$) | 4.3 | 5.8 | 6.8 | *1.1 | *3.4 | 5.0 | 7.1 | 9.5 | 10.2 | 9.8 | 8.4 | 6.4 | 5.1 | *3.8 |
| Amorphous Orientation Degree | *0.56 | 0.53 | 0.52 | *0.61 | *0.57 | 0.55 | 0.52 | 0.48 | 0.46 | 0.47 | 0.49 | 0.53 | 0.55 | *0.57 |
| Treated Cord | | | | | | | | | | | | | | |
| Tenacity (kg) | 13.3 | 13.8 | 14.0 | 14.3 | 14.4 | 14.1 | 14.0 | 13.9 | 13.6 | 13.8 | 13.9 | 14.1 | 14.1 | 14.2 |
| Elongation (%) under Load of 4.5 kg | 3.5 | 3.7 | 3.6 | 3.6 | 3.6 | 3.5 | 3.7 | 3.5 | 3.6 | 3.5 | 3.5 | 3.6 | 3.7 | 3.7 |
| 175° C. Dry-heat Shrinkage Factor (%) | *2.6 | 2.0 | 1.9 | *3.3 | *2.7 | 2.4 | 1.7 | 1.3 | 1.0 | 1.2 | 1.6 | 2.0 | 2.2 | *2.5 |
| Tube Life (min) | 430 | 460 | 510 | 240 | 300 | 450 | 480 | 520 | 630 | 570 | 490 | 460 | 450 | 330 |
| Heat-resistant Tenacity Retention Ratio (%) | 53 | 60 | 65 | 63 | 60 | 58 | 55 | 50 | 48 | 53 | 56 | 62 | 68 | 70 |
| Tube Life (min) | 430 | 460 | 510 | 240 | 300 | 450 | 480 | 520 | 630 | 570 | 490 | 460 | 450 | 330 |

Note
(com): comparison
*: condition or property outside the scope of the present invention

EXAMPLE 2

An undrawn fiber having properties described below was prepared in the same manner as described in Example 1 except that the amount added of 2,2'-bis(2-oxazoline) was changed to 0.15% by weight, the hole diameter was changed to 1.50 mm, the length of the heating cylinder below the spinneret was adjusted to 100 mm, the temperature of the heating cylinder was adjusted to 230° C., the cooling air blow-out distance was adjusted to 120 mm and the take-up speed was adjusted to 2500 m/min.

Intrinsic viscosity: 0.92
Terminal carboxyl group concentration: 8.0 equivalents/ton
Birefringence: 0.0707
Crystallization degree: 28.4%

A drawn fiber having properties described below was obtained by treating the above undrawn fiber in the same manner as described in Example 1 except that the drawn ratios $DR_1$, $DR_2$ and $DR_3$ were adjusted to 1.3, 1.50 and 1.05, respectively.

Fineness: 1005 denier
Strength: 7.4 g/d
Elongation: 10.1%
Long-period spacing: 165 Å
210° C. Dry-heat shrinkage factor: 5.1%
Melting point: 273° C.
Crystal volume: $5.3\times10^5$ (Å$^3$)
Amorphous orientation degree: 0.50

The properties of a dip cord obtained from the above drawn fiber were as follows.

Tenacity: 14.0 Kg
Elongation under load of 4.5 Kg: 3.5%
Elongation at break: 15.2%
175° C. Dry-heat shrinkage factor: 2.3%
Tube life: 450 minutes
Heat-resistant tenacity retention ratio: 67%

EXAMPLE 3

An autoclave was charged with 97 parts of dimethyl terephthalate, 69 parts ethylene glycol, 0.034 part of calcium acetate monohydrate and 0.025 part of antimony trioxide, and ester exchange reaction was carried out at 180° to 230° C. while gradually introducing nitrogen and removing methanol formed by the reaction. Then, 0.05 part of a 50% aqueous solution of $H_3PO_4$ was added and the heating temperature was elevated to 280° C. The pressure was gradually reduced to 0.2 mmHg over a period of about 1 hour, and polymerization was conducted for 1 hour and 50 minutes to obtain a polymer having an intrinsic viscosity of 0.80 and a terminal carboxyl group concentration of 28 equivalents per $10^6$ g of the polymer.

Then, 100 parts of the polymer chip was dry-blended with 2,2'-bis(2-oxazoline) (CE) in an amount shown in Table 2. The blend was melted at about 300° C. and transported and the melt was extruded from a spinneret having 250 holes, each having a diameter of 0.6 mm, and the extrudate was maintained under cooling conditions shown in Table 2 and the extrudate was cooled and solidified by blowing cooling air maintained at 25° C. along a length of 300 mm at a blow-out rate of 4.0 $Nm^3$/min. An oiling agent was applied to the extruded yarn by an oiling roller and wound at a take-up speed shown in Table 2 to obtain an undrawn fiber having properties shown in Table 2.

The undrawn fiber was supplied to a roller heated at 85° C. and subjected to first stage drawing between this roll and a take-up roll at a draw ratio ($DR_1$) shown in Table 2 and was then subjected to second stage drawing through a gas bath maintained at 325° C. at a draw ratio ($DR_2$) shown in Table 2. Then, the fiber was subjected to a relax heat treatment at a drawn ratio ($DR_3$) shown in Table 2 by using a roller heated at 130° C. and a gas bath maintained at 330° C. to obtain a drawn yarn having properties shown in Table 2.

The tube life in Table 2 indicates the fatigue resistance. A cord was prepared and the tube life was measured in the following manner.

The drawn yarn was Z-twisted at 490 turns per meter, and two of the so-twisted yarns were combined and S-twisted at 490 turns per meter to form a green cord of 1000 denier×2 yarns. The green cord was dipped in an adhesive (RFL solution) and subjected to a stretch heat treatment at 245° C. for 2 minutes. The treated cord was embedded in a rubber and the rubber was cured, and the tube life was measured.

Figure 2:
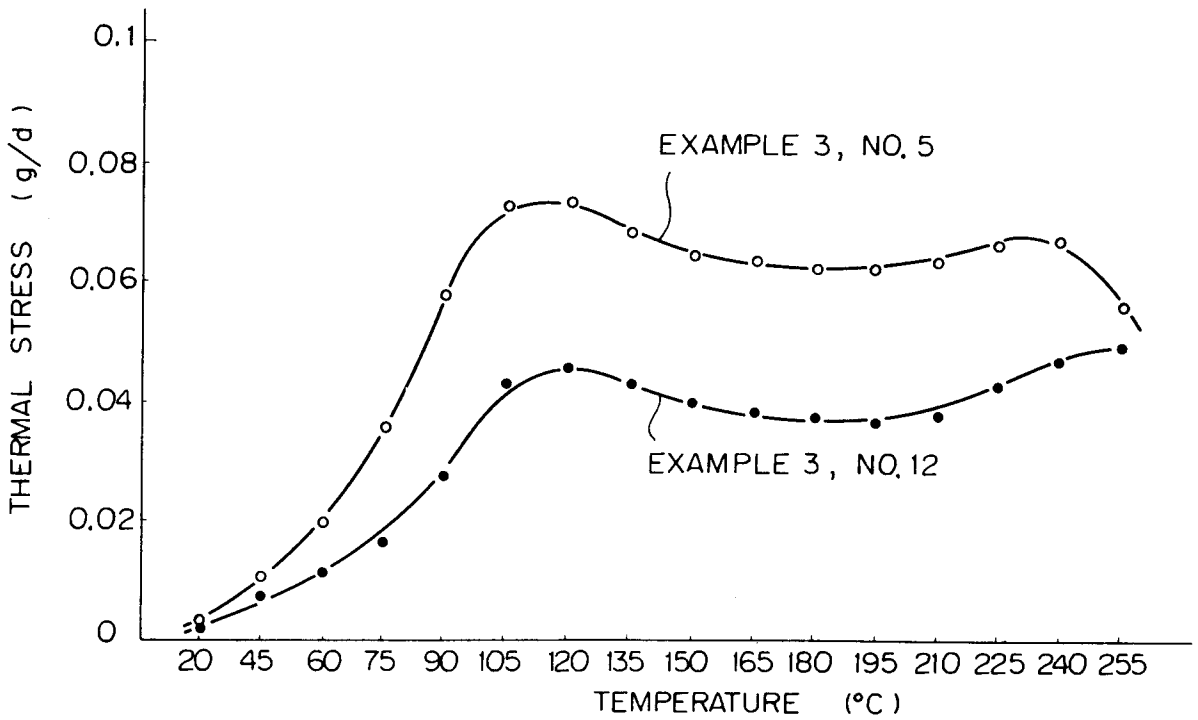
FIG. 2 shows temperature-thermal stress curves of fibers obtained in the examples of the present invention.

The temperature-shrinkage factor curves of the fibers of Run Nos. 5 and 10 (fibers of the present invention) are shown in FIG. 1, and the temperature-thermal stress curves of the fibers of Run Nos. 5 and 12 are shown in FIG. 2.

TABLE 2

| | Run No. | | | | | | | | | | | | | | |
|---|---|---|---|---|---|---|---|---|---|---|---|---|---|---|---|
| | 1 (com) | 2 | 3 | 4 (com) | 5 | 6 | 7 | 8 | 9 | 10 | 11 | 12 | 13 | 14 | 15 |
| Amount (% by weight) of Added CE | 0.05 | 0.15 | 0.22 | 0.15 | 0.15 | 0.15 | 0.15 | 0.15 | 0.15 | 0.15 | 0.15 | 0.15 | 0.15 | 0.15 | 0.15 |
| Cooling Conditions | | | | | | | | | | | | | | | |
| Length (mm) of Heating Zone below Spinneret | 100 | 100 | 100 | 300 | 300 | 300 | 300 | 300 | 100 | 200 | 200 | 200 | 200 | 300 | 300 |
| Temperature (°C.) of Heating Zone | 230 | 230 | 230 | 230 | 230 | 230 | 230 | 230 | 230 | 230 | 230 | 300 | 300 | 350 | 350 |
| Cooling Air Blow-out Distance (mm) | 180 | 180 | 180 | 440 | 440 | 440 | 440 | 440 | 180 | 350 | 350 | 350 | 350 | 440 | 440 |
| Take-up Speed (m/min) | 3500 | 3500 | 3500 | 2500 | 3500 | 4000 | 5000 | 6000 | 4000 | 4000 | 4000 | 4000 | 4000 | 4000 | 4000 |
| Undrawn Fiber | | | | | | | | | | | | | | | |
| Intrinsic Viscosity | *0.85 | 0.95 | 1.01 | 0.93 | 0.95 | 0.95 | 0.96 | 0.96 | 0.95 | 0.94 | 0.94 | 0.94 | 0.94 | 0.92 | 0.92 |
| Terminal Carboxyl Group Concentration (equivalents/ton) | 18.5 | 7.2 | 6.5 | 7.8 | 7.3 | 7.2 | 7.0 | 6.8 | 7.3 | 7.5 | 7.5 | 7.5 | 7.5 | 8.2 | 8.2 |
| Birefringence | 0.0734 | 0.0866 | 0.0954 | *0.0453 | 0.0626 | 0.0817 | 0.927 | 0.1081 | 0.136 | 0.0948 | 0.0875 | 0.0875 | 0.0875 | 0.0657 | 0.0657 |
| Crystallization Degree (%) | 21.7 | 24.6 | 27.1 | 14.7 | 19.3 | 23.6 | 26.5 | 30.3 | 36.8 | 26.8 | 25.3 | 25.3 | 25.3 | 20.1 | 20.1 |
| Drawing and Heating Treatment | | | | | | | | | | | | | | | |
| $DR_1$ | 1.4 | 1.3 | 1.3 | 1.7 | 1.5 | 1.4 | 1.3 | 1.25 | 1.2 | 1.3 | 1.5 | 1.5 | 1.5 | 1.6 | 1.6 |
| $DR_2$ | 1.25 | 1.27 | 1.23 | 1.26 | 1.23 | 1.24 | 1.26 | 1.23 | 1.20 | 1.26 | 1.22 | 1.22 | 1.22 | 1.23 | 1.23 |
| $DR_3$ | 0.93 | 0.93 | 0.93 | 0.90 | 0.90 | 0.93 | 0.93 | 0.93 | 0.93 | 0.93 | 0.93 | 0.95 | 0.90 | 0.85 | 0.80 |
| Drawn Fiber | | | | | | | | | | | | | | | |
| Fineness (denier) | 1005 | 1006 | 1004 | 1007 | 1010 | 1005 | 1005 | 1004 | 1007 | 1006 | 1004 | 1008 | 1006 | 1007 | 1009 |
| Tenacity (g/d) | *5.4 | 6.5 | 7.5 | 8.0 | 7.6 | 7.5 | 7.1 | 6.7 | 5.9 | 7.2 | 7.7 | 8.1 | 7.5 | 7.1 | 6.5 |
| Elongation (%) | 14.2 | 13.8 | 13.6 | 13.5 | 15.4 | 13.6 | 13.3 | 13.1 | 13.3 | 13.2 | 13.4 | 12.3 | 16.4 | 20.1 | 24.4 |
| 210° C. Dry-heat Shrinkage Factor (%) | 3.9 | 2.9 | 1.3 | 5.8 | 4.0 | 3.1 | 1.7 | 0.8 | 0.5 | 1.4 | 2.8 | 3.0 | 2.6 | 2.2 | 1.8 |
| First Thermal Stress Peak Temperature (°C.) | 113 | 116 | 117 | *not 180° C. | 112 180° C. | 115 | 117 | 120 | 130 | 116 | 115 | 114 | 118 | 120 | 123 |
| First Thermal Stress (g/d) | *0.074 | 0.041 | 0.031 | 0.050 | 0.076 | 0.036 | 0.031 | 0.027 | 0.021 | 0.033 | 0.037 | 0.043 | 0.026 | 0.013 | 0.010 |
| Second Thermal Stress Peak Temperature (°C.) | 240 | 247 | 265 | 240 | 233 | 245 | 255 | 266 | 273 | 260 | 248 | 245 | 250 | 252 | 256 |
| Crystal Volume (Å $\times 10^5$) | 4.36 | 4.68 | 7.42 | *3.72 | 4.15 | 4.53 | 6.68 | 8.05 | 8.46 | 7.13 | 4.86 | 4.57 | 5.37 | 6.13 | 6.54 |
| Tube Life (min) | 400 | 430 | 480 | 210 | 300 | 420 | 450 | 490 | 600 | 460 | 430 | 440 | 410 | 380 | 350 |
| Melting Point (°C.) | 266 | 267 | 273 | 264 | 266 | 267 | 272 | 275 | 275 | 272 | 267 | 267 | 269 | 270 | 271 |
| Peak Temperature (°C.) | 116 | 111 | 105 | 127 | 120 | 115 | 107 | 102 | 101 | 105 | 111 | 110 | 112 | 109 | 107 |
| Peak Half-Value Width (°C.) | 43 | 43 | 41 | 47 | 44 | 43 | 41 | 40 | 40 | 41 | 42 | 42 | 43 | 42 | 41 |

COMPARATIVE EXAMPLE

An autoclave was charged with 97 parts of dimethyl terephthalate, 69 parts of ethylene glycol, 0.034 part of calcium acetate monohydrate and 0.025 part of antimony trioxide, and ester exchange reaction was carried out at 180° to 230° C. while gradually introducing nitrogen and removing methanol formed by the reaction. Then, 0.05 part of a 50% aqueous solution of $H_3PO_4$ was added and the heating temperature was elevated to 280° C., and the pressure of the reaction system was gradually reduced to 0.2 mmHg over a period of about 1 hour and polymerization was conducted for 1 hour and 50 minutes to obtain a polymer having an intrinsic viscosity of 0.80 and a terminal carboxyl group concentration of 28 equivalents/$10^6$ g of the polymer.

The polymer chip was melted at about 290° C. and transported, and the melt was extruded from a spinneret having 192 holes, each having a diameter of 0.6 mm. The extrudate was gradually cooled through a heating cylinder and solidified by blowing air maintained at 25° C. along a length of 300 mm at a blow-out rate of 4.8 $Nm^3$/min. An oiling agent was applied to the extruded yarn by an oiling roller, and the extruded yarn was wound at a speed of 829 m/min to obtain an undrawn yarn having the following properties.

Intrinsic viscosity: 0.78
Terminal carboxyl group concentration: 33 equivalents/ton of the polymer
Elongation at break: 410%
Birefringence: 0.0033
Crystallization degree: 0

The undrawn fiber was supplied to a roll heated at 85° C. and subjected to first stage drawing between this roll and a take-up at a drawn ratio of 3.7. Then, the fiber was subjected to second stage drawing through a gas bath heated at 305° C. at a drawn ratio of 1.45. Then the fiber was subjected to a relax heat treatment at a draw ratio of 0.87 by using a roller heated at 180° C. and a gas bath maintained at 265° C. to obtain a drawn yarn having the following properties.

Fineness: 1005 denier
Strength: 8.2 g/d
Elongation: 24.6%
210° C. Dry-heat shrinkage factor: 6.5%
Thermal stress peak: one peak at 120° C.
Melting point: 261° C.
Crystal volume: $3.95\times10^5$ Å$^3$ The temperature-shrinkage factor curve of the obtained fiber (Comparative Example) is shown in FIG. 1.

EXAMPLE 4

An undrawn yarn having properties described below was prepared in the same manner as in Run No. 9 of Example 2 except that the hole diameter of the spinneret was changed to 1.5 mm and the take-up speed was adjusted to 2500 m/min.

Intrinsic viscosity: 0.95
Terminal carboxyl group concentration: 7.5 equivalents/ton
Birefringence: 0.0854
Crystallization degree: 24.3%

A drawn yarn having properties below was prepared from this undrawn yarn in the same manner as Run No. 7 of Example 4.

Fineness: 1007 denier
Strength: 7.2 g/d
Elongation: 14.3%
210° C. Dry-heat shrinkage factor: 1.6%
Crystal volume: $6.43\times10^5$ Å$^3$
Melting point: 273° C.

We claim:

1. A polyester fiber composed of a polyester comprising ehtylene terephthalate units as the main recurring units and having an intrinsic viscosity of at least 0.90, wherein the amorphous orientation degree is in the range of from 0.30 to 0.55, wherein the peak temperature of the meain dispersion appearing in the temperature dispersion of the dynamic loss elasticity modulus is lower than 125° C., and the crystal melting point is at least 270° C.

2. A polyester fiber as set forth in claim 1, wherein the crystal volume is at least $4.0\times10^5$ Å$^3$.

3. A polyester fiber as set forth in claim 1, wherein the dry-heat shrinkage factor at 210° C. is less then 6%.

4. A polyester fiber as set forth in claim 1, wherein the terminal module is less than 10 g/d.

5. A polyester fiber as set forth in claim 1, wherein the long-period spacing is at least 160 Å.

6. A polyester fiber as set forth in claim 1, which is obtained by drawing a polyester fiber composed of a polyester comprising ethylene terephthalate units as the main recurring units and having an intrinsic viscosity of at least 0.90, said polyester fiber having an elongation at break of less than 150% and satisfying the requirement of $Xx=2.4\times10^2\times\Delta n+4$ in which Xx stands for the crystallization degree determined by the X-ray wide angle diffractometry and Δn stands for the birefringence, which is at least 0.06, and heat-treating the drawn polyester fiber under a stretch of from 20% to −20%.

7. A polyester fiber as set forth in claim 1, wherein the half-value width of the main dispersion appearing in the temperature dispersion of the dynamic loss elasticity modulus is less than 45° C.

8. A polyester fiber as set forth in claim 1, wherein thermal stress peaks appear at a temperature of 100° to 180° C. and a temperature higher than 180° C., respectively, in the temperature-thermal stress curve.

* * * * *